US006023785A

United States Patent [19]

Johnson

[11] Patent Number: 6,023,785

[45] Date of Patent: Feb. 15, 2000

[54] SIZE ADJUSTABLE BRA

[76] Inventor: Christina Erteszek Johnson, 21914 Goldstone Rd., Topanga, Calif. 90290

[21] Appl. No.: 09/232,714

[22] Filed: Jan. 19, 1999

Related U.S. Application Data

[63] Continuation-in-part of application No. 08/967,642, Nov. 10, 1997, Pat. No. 5,863,236.

[51] Int. Cl.[7] ..... A41C 3/00

[52] U.S. Cl. ..... 2/62; 450/60; 450/63; 450/64; 450/79; 450/84

[58] Field of Search ..... 450/1, 4, 23, 75, 450/65, 66, 77, 79, 84, 85, 86, 62, 5, 92, 93, 7–10, 70, 14–16, 55–64, 19–28, 80–82; 2/76, 67, 69, 105, 106, 113–115, 109–110

[56] References Cited

U.S. PATENT DOCUMENTS

| | | | |
|---|---|---|---|
| 525,241 | 8/1894 | Tucek . | |
| 1,242,118 | 10/1917 | Anderman . | |
| 1,306,595 | 6/1919 | Jerome . | |
| 1,352,974 | 9/1920 | Kops . | |
| 1,400,883 | 12/1921 | Kops . | |
| 1,415,655 | 5/1922 | Kops | 450/84 |
| 1,494,119 | 5/1924 | Kops . | |
| 1,878,755 | 9/1932 | Caldor . | |
| 2,100,890 | 11/1937 | Witkower . | |
| 2,156,478 | 5/1939 | Kemp | 450/84 |
| 2,378,908 | 6/1945 | Blum . | |
| 2,650,363 | 9/1953 | Lo Cascio . | |
| 3,131,696 | 5/1964 | Krakower et al. . | |
| 4,300,568 | 11/1981 | Blanckmeister . | |
| 4,781,651 | 11/1988 | Ekins . | |
| 5,149,293 | 9/1992 | Gable . | |
| 5,221,227 | 6/1993 | Michels . | |
| 5,863,236 | 1/1999 | Johnson | 450/62 |

FOREIGN PATENT DOCUMENTS 857747 1/1961 United Kingdom .

OTHER PUBLICATIONS

Gershman, Maurice, "Self–Adhering Nylon Tapes", The J.A.M.A., vol. 168, No. 7, p. 930, 1958.

*Primary Examiner*—Gloria Hale
*Attorney, Agent, or Firm*—William W. Haefliger

[57] ABSTRACT

In a fit adjustable brassiere, the combination comprising front structure including a flexible, frontal fabric panel at the front side of the brassiere; a halter, including two transversely spaced support bands having lower frontal extents associated with front structure and extending upwardly relative to frontal fabric panel, and then downwardly at the rear side of the brassiere to define lower rearward extents; rear structure associated with and extending below the band lower rearward extents; and there being a first wing carried by the rear structure and configured to freely extend toward front structure and at one side of the brassiere, and there being a second wing carried by rear structure at the other side of the brassiere, the wings having independently adjustable position connections with front structure to transfer force from rear structure to front structure.

11 Claims, 4 Drawing Sheets

FIG. 3.
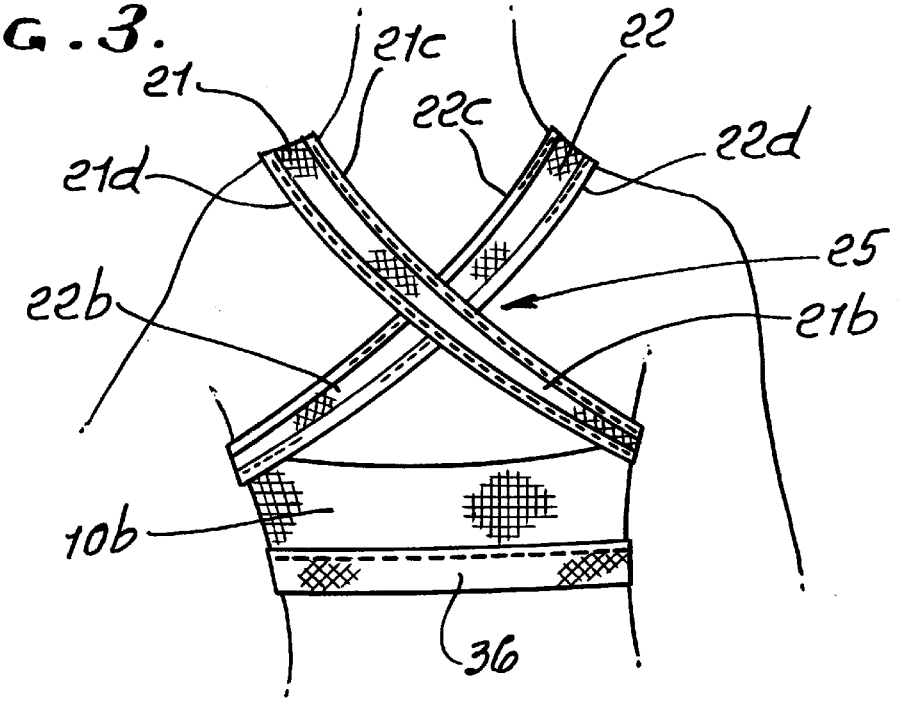
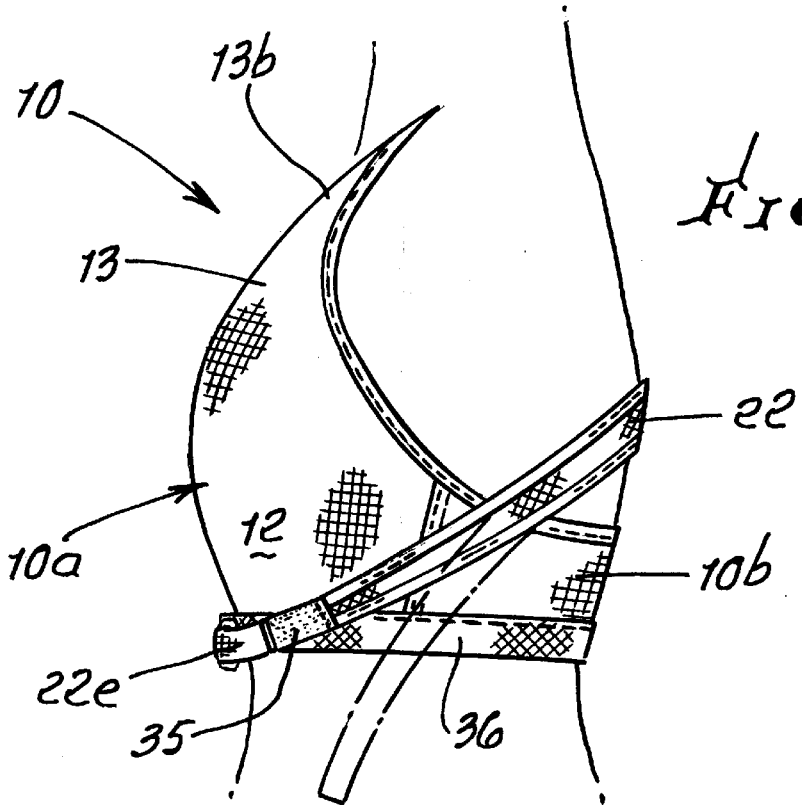
FIG. 4.

SIZE ADJUSTABLE BRA

This application is a continuation-in-part of prior U.S. patent application Ser. No. 08/967,642, filed Nov. 10, 1997, now U.S. Pat. No. 5,863,236.

BACKGROUND OF THE INVENTION

This invention relates generally to brassieres, and more particularly to an improved brassiere providing very comfortable and readily adjustable fit to the wearer's torso.

There is continual need for brassieres that provide enhanced comfort and readily adjustable fit. Traditional bras provide bust control via shoulder strap adjustment. This often causes discomfort in the neck and back areas. There is also need for improved active wear brassieres, as for example are worn during active exercise, and which provide constant comfort and support, and which enable readily adjustable fit. For example, a brassiere should be capable of ready, partial loosening, as after active, vigorous exercise, and still provide needed support for comfort. There is additional need for a bra that controls the bust cup capacity and the sides of the busts, together or independently of one another.

SUMMARY OF THE INVENTION

It is a major object of the invention to provide an improved brassiere meeting the above needs. Basically, the improved brassiere is wrap-fit adjustable, as well as size adjustable, and comprises, in combination:

a) front structure including a flexible, frontal fabric panel at the front side of the brassiere, b) a halter, including two transversely spaced support bands having lower frontal extents associated with said front structure and extending upwardly relative to said frontal fabric panel, and then downwardly at the rear side of the brassiere to define lower rearward extents, c) and rear structure associated with and extending below said band lower rearward extents, d) there being a first wing carried by the rear structure and configured to freely extend toward said front structure at one side of the brassiere, and there being a second wing carried by said rear structure and configured to freely extend toward said front structure at the other side of said brassiere, said wings having independently adjustable position connections with said front structure to transfer force from said rear structure to said front structure.

It is another object to provide the wings to be free of any upper support straps connected thereto, proximate said front structure. The wings may typically have overlapping extents centrally of the brassiere.

Another object of the invention includes provision of structure wherein said adjustable position connections of the wings to said front structure are located generally medially of and below said frontal fabric panel. The connections may include VELCRO, look and loop fastener attachments. Such buckle structure firmly holds lower frontal extent of the brassiere to the torso of the wearer. Elasticized means integrated with the brassiere may include a band having operative connection to lower extents of the two bust-support panel regions.

A further object includes provision of buckle structure carried by said front structure and to which said wings are individually adjustably connected.

Yet another object concerns orientation of the two wings, such that one wing is at the left side of the brassiere and oriented to direct loading toward a halter band at the upper right side of the brassiere, and the other wing is at the right side of the brassiere, and oriented to direct loading toward a halter band at the upper left side of the brassiere.

Additionally, one or more flexible panels of the brassiere, as well as the halter bands, may consist of a soft, two-way stretchable knit fabric, the wing or wings associated with the rear panel, for maximum comfort.

These and other objects and advantages of the invention, as well as the details of an illustrative embodiment, will be more fully understood from the following specification and drawings, in which:

DRAWING DESCRIPTION

FIG. 3 is a rear elevation showing the brassiere;

FIG. 4 is a left side view of the brassiere seen in FIG. 1; the right side being the same, but mirror imaged;

DETAILED DESCRIPTION

Figure 1:
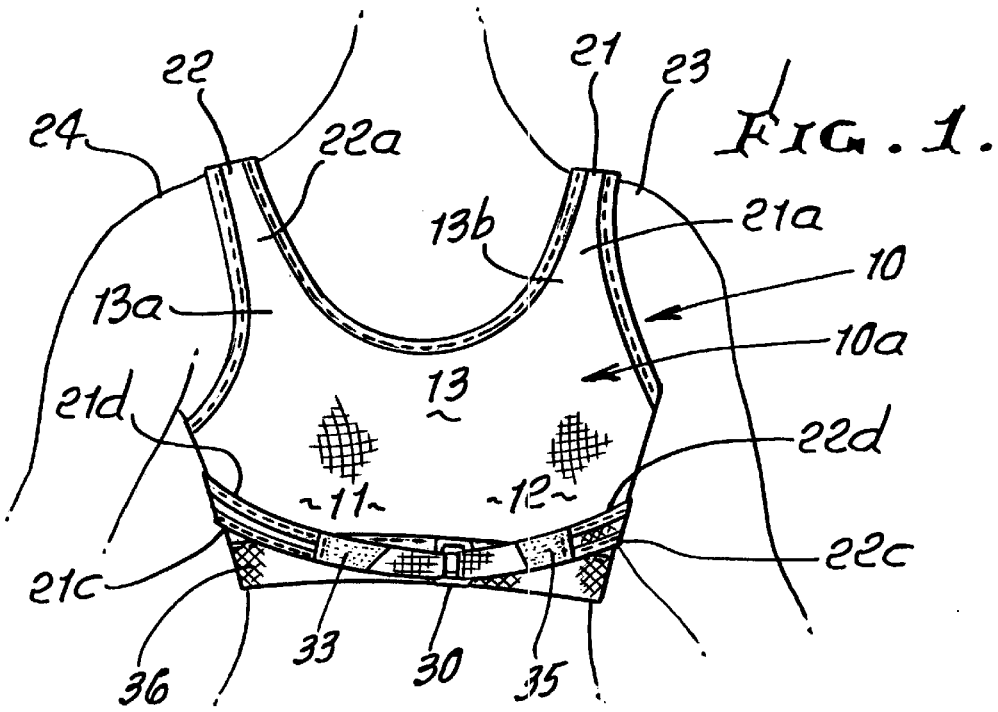
FIG. 1 is a frontal view showing an adjustable brassiere incorporating the invention; and with wings attached to front structure.

In the drawings, the brassiere 10 comprises front structure 10*a* that includes transversely spaced, local, left and right bust-support regions 11 and 12, and a flexible, frontal panel 13 between and interconnecting zones 11 and 12 at the brassiere front. Structure 10*a* consists of comfortable, two-way, stretchable knit fabric, such as cotton; and fabric zones 11 and 12 may also typically consist of such knit fabric.

The brassiere also includes two transversely spaced support bands 21 and 22, which may advantageously be between ¾ and 1½ inches in width. These bands have lower frontal extents at 21*a* and 22*a* that are associated with the front structure 10*a*, and may be upward continuations of same. For example, the bands may be connected to the upper extents 13*a* and 13*b* of front panel 13. The two bands extend upwardly, to cross rearwardly over the wearer's shoulders 23 and 24, and then downwardly at the rear side of the brassiere to cross over one another at 25, medially of the wearer's back. See FIG. 3.

The brassiere 10 also includes rear panel structure 10*b* associated with and extending below band lower extents 21*b* and 22*b*. The bands 21 and 22, and rear panel 10*b*, may also consist of comfortable, two-way stretchable fabric, such as a thin layer of cotton knit material. Seam binding at edging of the straps is shown at 21*c* and 21*d*; and 22*c* and 22*d*.

In accordance with an important aspect of the invention, a first wing is carried by the rear structure and configured to freely extend toward said front structure at one side of the brassiere, and a second wing carried by said rear structure and configured to freely extend toward said front structure at the other side of said brassiere, said wings having adjustable position connections with said front structure to transfer force from said rear structure to said front structure.

Figure 2:
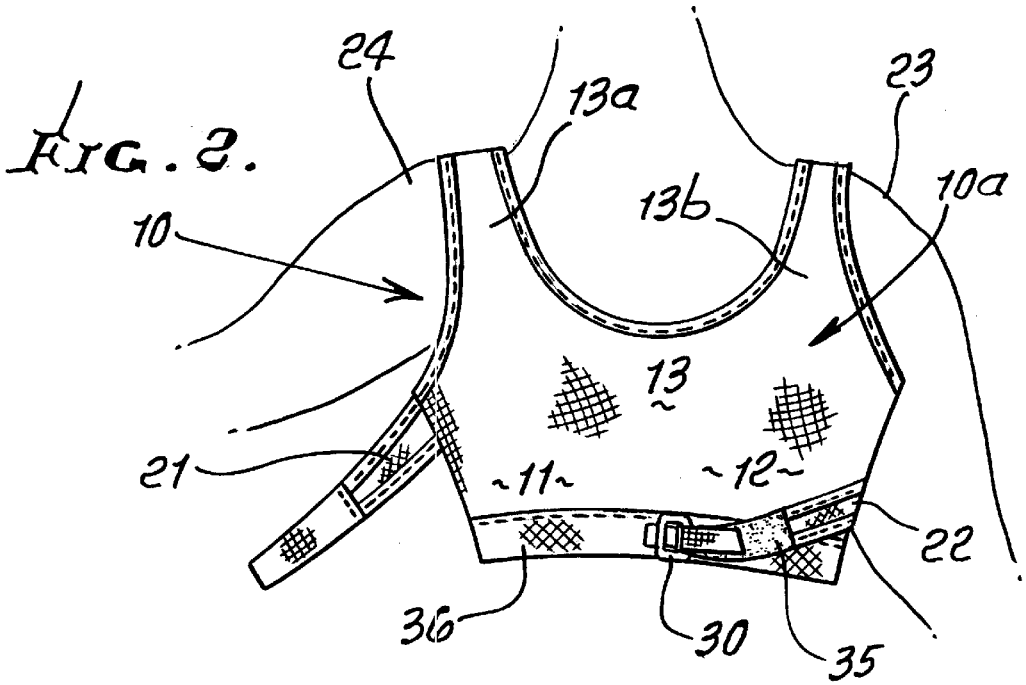
FIG. 2 is a frontal view of the brassiere seen in FIG. 1 but showing one adjustable wing detached from frontal structure.
Figure 5:
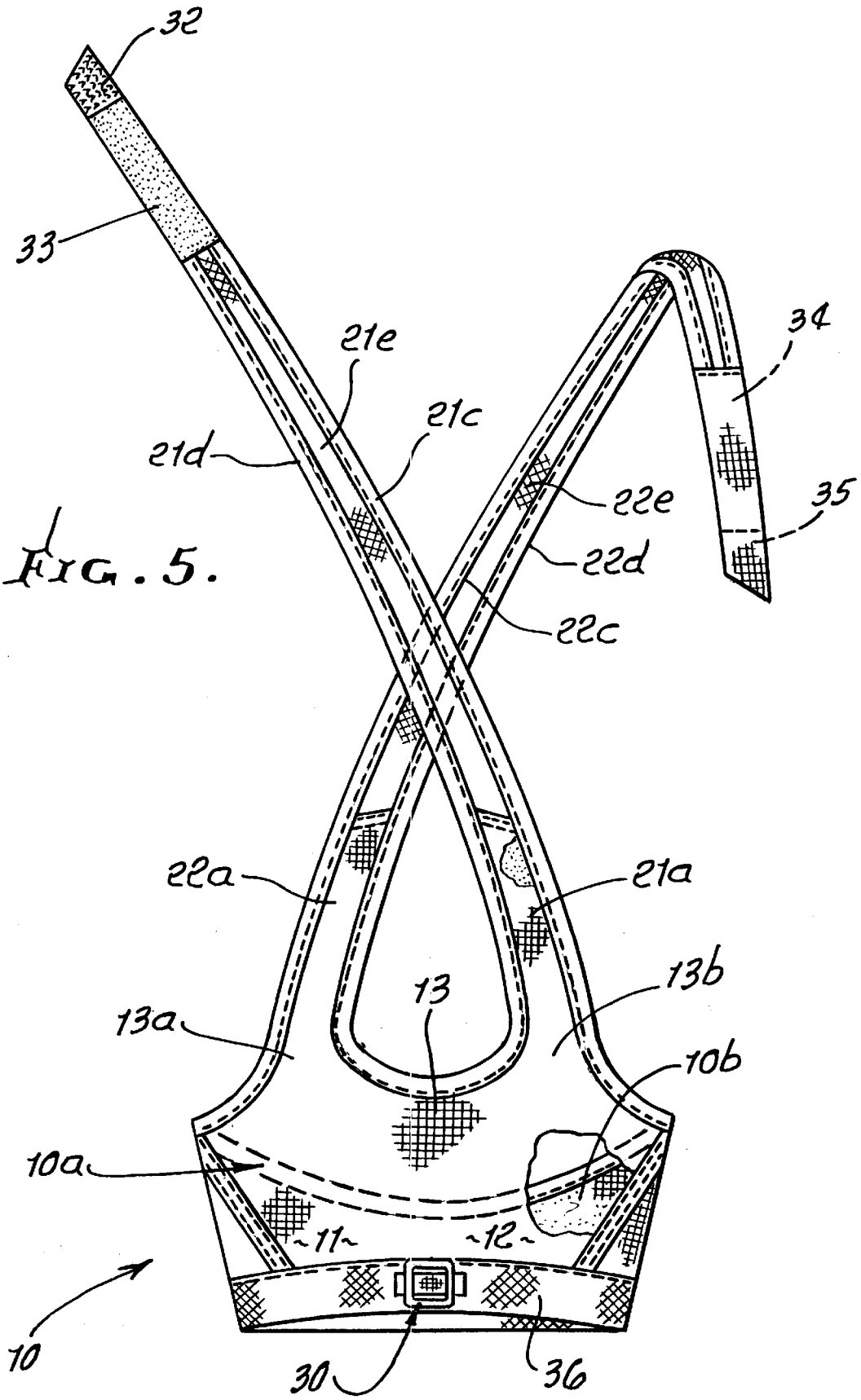
FIG. 5 is a plan view of the FIG. 1 brassiere, shown as supported on a flat surface.
Figure 6:
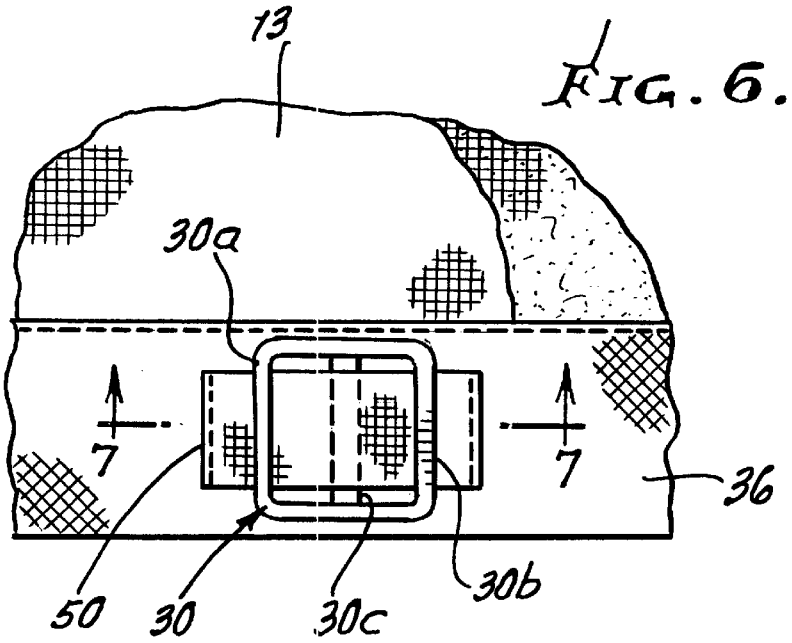
FIG. 6 is an enlarged frontal vie3 of the buckle connection.
Figure 7:
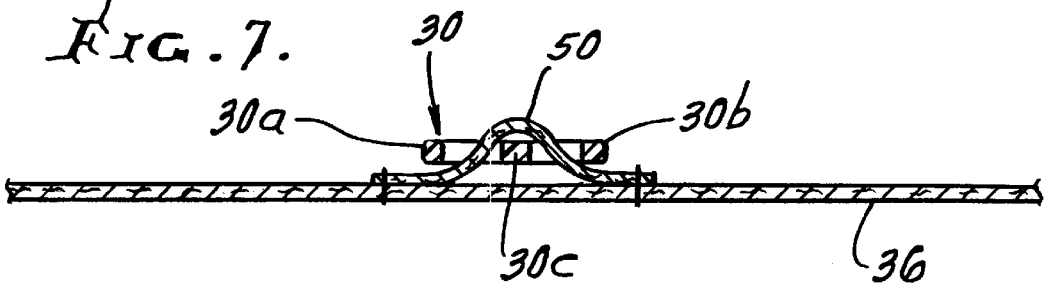
FIG. 7 is an enlarged section taken on lines 7—7 of FIG. 6.

As seen in FIGS. 1 and 2 the first wing takes the form of end extent 21*e* of the band 21, and the second wing takes the form of end extent 22*e* of the band 22. Those end extents or wings are free of any upper support straps connected thereto, proximate said front structure. Also, the first wing is at the right side of the brassiere and oriented to direct loading toward the lower right side of the brassiere, and said second wing is at the left side of the brassiere, and oriented to direct loading toward the lower left of the brassiere.

In the example, the adjustable position connections of the wings to said front structure are located generally medially of and below said frontal fabric panel.

Figure 8:
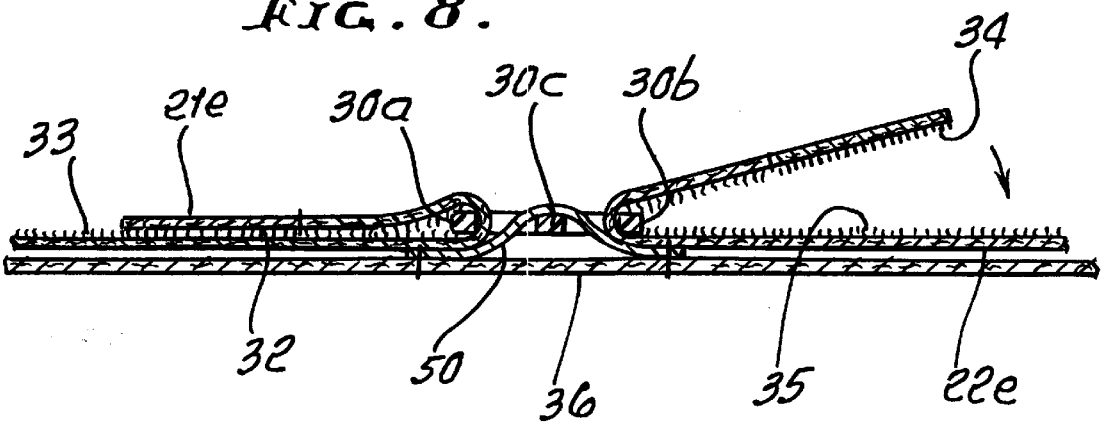
FIG. 8 is a view like FIG. 7, showing wing or strap connections to the buckle.

Buckle structure is shown at 30 to be carried by the brassiere front structure, and the wings are shown as adjustably connected to the buckle structure. The wing or strap end extent 21*e* is shown as lengthwise adjustably folded back over the buckle rib 30*a*, so that VELCRO, hook and loop fastener 32 on one side of the wing end can be adjustably attached to VELCRO, hook and loop fastener 33 on the inner side of that wing (see FIG. 8). Likewise, the wing or strap and extent 22*e* is lengthwise adjustably folded back over the buckle rib 30*b*, so that VELCRO, hook and loop fastener 34 on one side of that wing can be adjustably attached to VELCRO, hook and loop fastener 35 on the inner side of that wing.

The buckle is advantageously carried by a lower band 36 of the brassiere that extends about the wearer's torso, and is attached as by a sub-band 50 that extends over buckle central rib 30*c*, and which is stitched to band 36.

Band 36 is continuous and stretchable to fit over the wearerts head.

Adjustment of the wings and their attachment to the buckle enables ease of adjustment fitting of the brassiere to the wearer's upper torso, each time the brassiere is worn; and allows for rapid adjustable loosening of either or both sides of the brassiere, for example after vigorous exercise, for comfort purposes.

Figure control is also enabled, since the wing narrow end portions exert inwardly directed and localized pressure under the bust side areas, the panels 11 and 12 acting to spread or distribute such pressure for comfort. Note that the wings are angled upwardly at 21*d* and 22*d* as they extend away from the buckle, and above the band 36, to press the lower bust areas toward one another.

The brassiere preferably includes said elasticized band means 36 associated with the front and rear structures 10*a* and 10*b* for firmly holding or retaining lower extents of the brassiere to the torso of the wearer, under the bust level. As shown, such elasticized band means 36 has operative connection to lower extents of the panels 11 and 12, and encircling the torso. Also, since the buckle is carried by the elasticized band, position shifts of the buckle is minimized as the wearer's torso shifts, and the positions of the wings are stabilized.

From the above, it will appear that the invention provides the following advantages:

a) the bra controls bust cup capacity, and the sides of the busts, together or independently of one another;

b) front and back compression, achieved by the adjustable wrapping feature, and by the full back yoke design, lessens pressure on the neck and shoulders, and improves posture, c) the improved bra design is of particular advantage to large-busted women because control and support are achieved by the back-to-front adjustable wrap construction.

I claim:

1. In a fit adjustable brassiere, the combination comprising:

a) front structure including a flexible, frontal fabric panel at a front side of the brassiere, b) a halter, including two transversely spaced support bands having lower frontal extents associated with said front structure and extending upwardly relative to said frontal fabric panel, and then downwardly at a rear side of the brassiere to define lower rearward extents, c) and rear structure associated with and extending below said band lower rearward extents, d) there being a first wing carried by the rear structure and configured to freely extend toward said front structure at one side of the brassiere, and there being a second wing carried by said rear structure and configured to freely extend toward said front structure at the other side of said brassiere, said wings having independently adjustable position connections with said front structure to transfer force from said rear structure to said front structure.

2. The combination of claim 1 wherein said wings are free of any upper support straps connected thereto, proximate said front structure.

3. The combination of claim 1 wherein said adjustable position connections of the wings to said front structure are located generally medially of and below said frontal fabric panel.

4. The combination of claim 1 including buckle structure carried by said front structure and to which said wings are individually adjustably connected.

5. The combination of claim 1 wherein each of said adjustable connections include a hook and loop fastener attachment.

6. The combination of claim 1 wherein said first wing is at a right side of the brassiere and oriented to direct loading toward a lower right side of the brassiere, and said second wing is at a left side of the brassiere, and oriented to direct loading toward a lower left of the brassiere.

7. The combination of claim 6 wherein the wings have overlapping extents, providing support, centrally of the brassiere.

8. The combination of claim 4 wherein said brassiere includes elasticized band means associated with said front and rear structures for firmly holding a lower extent of the brassiere to the torso of the wearer, said elasticized band means carrying said buckle structure so that the buckle structure and wings may shift their positions in response to position shifting of the wearer's torso and said band means.

9. The combination of claim 8 wherein said elasticized band means includes a torso encircling band having operative connection to lower extents of said front and rear structures.

10. The combination of claim 1 wherein said flexible frontal panel consists of two-way stretchable knit fabric.

11. The combination of claim 1 wherein said halter bands consist of two-way stretchable knit fabric.

* * * * *